US006647887B2

(12) United States Patent
Smith et al.

(10) Patent No.: US 6,647,887 B2
(45) Date of Patent: Nov. 18, 2003

(54) LINEAR IGNITION FUZE WITH SHAPED SHEATH

(75) Inventors: Leonard Smith, Surprise, AZ (US); Gregory B. Dougherty, Lodi, CA (US); Michael H. Tolson, Vacaville, CA (US); David L. Harrington, Fairfield, CA (US)

(73) Assignee: Universal Propulsion Company, Inc., Phoenix, AZ (US)

( * ) Notice: Subject to any disclaimer, the term of this patent is extended or adjusted under 35 U.S.C. 154(b) by 0 days.

(21) Appl. No.: 10/158,088

(22) Filed: May 29, 2002

(65) Prior Publication Data

US 2002/0189481 A1 Dec. 19, 2002

Related U.S. Application Data

(60) Provisional application No. 60/294,961, filed on May 31, 2001.

(51) Int. Cl.[7] ..... C06C 5/00

(52) U.S. Cl. ..... 102/275.1

(58) Field of Search ..... 102/275.1–275.11, 102/288, 289

(56) References Cited

U.S. PATENT DOCUMENTS

| | | | | | |
|---|---|---|---|---|---|
| 3,590,739 | A | * | 7/1971 | Persson | 102/275.8 |
| 4,220,087 | A | | 9/1980 | Posson | |
| 4,757,764 | A | * | 7/1988 | Thureson et al. | 102/275.8 |
| 4,817,673 | A | * | 4/1989 | Zoghby et al. | 102/275.1 |
| 5,540,154 | A | | 7/1996 | Wilcox et al. | |
| 5,827,994 | A | * | 10/1998 | Gladden et al. | 102/275.8 |

FOREIGN PATENT DOCUMENTS

| | | | | |
|---|---|---|---|---|
| GB | 2054108 | * | 2/1981 | 102/275.1 |

* cited by examiner

*Primary Examiner*—Harold J. Tudor
(74) *Attorney, Agent, or Firm*—Jerry Holden; John D. Titus

(57) ABSTRACT

A linear ignition fuze has a sheath, the inner surface of which has an irregular cross section such that the sheath is capable of forming a gas channel against a single strand core having a substantially circular (e.g. circular or elliptical) cross section. According to one embodiment of the invention, the sheath wall is of a non-uniform thickness having a cylindrical outer surface and a polygonal inner surface. The gap formed between the apexes of the polygonal inner surface and the substantially cylindrical core form the gas channels, while the contact between the side walls of the polygonal inner surface and the cylindrical core confine the core within the sheath.

12 Claims, 1 Drawing Sheet

LINEAR IGNITION FUZE WITH SHAPED SHEATH

This application claims benefit of U.S. provisional application Ser. No. 60/294,961 filed on May 31, 2001.

TECHNICAL FIELD

This invention relates generally to ignition fuzes and more particularly to a non-detonative linear ignition fuze suitable for use in gas generators and other applications requiring substantially instantaneous ignition of a material distributed along the exterior length of the fuze.

BACKGROUND OF THE INVENTION

Linear ignition fuzes of the prior art generally comprise a core of non-detonating, ignitive material comprising a mixture of particulate fuel, oxidant, and a binder encased within a frangible sheath, with a longitudinally extending gas channel adjacent to the ignitive material of the core. The gas channel is defined by the shape and location of the strands that define the elongated core in relationship to the inner surface of the sheath circumscribing the core. U.S. Pat. No. 4,220,087 to Posson (the '087 patent) discloses a linear ignition fuze in which the core is encased in a tubular sheath having a circular or an elliptical cross section of uniform wall thickness. The core comprises a bundle of three or more cylindrical strands or other shapes that form gas channels against the curved walls of the sheath and or between the cylindrical bundles forming the core. The linear ignition fuze disclosed in the '087 patent has a number of drawbacks, including the high cost associated with manufacturing the multiple strand core or the irregularly shaped core necessary to form the gas channels against the circular or elliptical side walls of the sheath.

The present invention comprises an improved linear ignition fuze in which the inner surface of the sheath has an irregular cross section such that the sheath is capable of forming a gas channel against a single strand core having a substantially circular (e.g. circular or elliptical) cross section. According to one embodiment of the invention, the sheath wall is of a non-uniform thickness having a cylindrical outer surface and a polygonal inner surface. The gap formed between the apexes of the polygonal inner surface and the substantially cylindrical core form the gas channels, while the contact between the side walls of the polygonal inner surface and the cylindrical core confine the core within the sheath. Because the linear ignition fuze of the present invention requires only a single strand core having a closed curve cross section, as opposed to a bundle of three or more strands, a cruciform or other oddly shaped cross section that is difficult to manufacture in an extrusion process, the present invention provides a highly cost-effective, easily produced linear ignition fuze having performance equivalent to the more expensive prior art linear ignition fuzes.

BRIEF DESCRIPTION OF THE DRAWING

The present invention will be better understood from a reading of the following detailed description, taken in conjunction with the accompanying drawing figures in which like references designate like elements and, in which.

DESCRIPTION OF THE PREFERRED EMBODIMENTS

Figure 1:
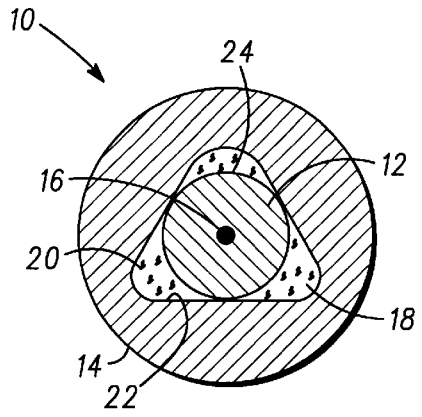
FIG. 1 is an enlarged transverse cross-sectional view of the linear ignition fuze contemplated by the present invention.

As illustrated in FIG. 1, a fuze 10 includes a strand 12 having a closed arcuate cross section encased within an imperforate tubular sheath 14. (As used herein, "a closed arcuate cross section" means a substantially (within normal manufacturing tolerances) circular or elliptical cross-sectional shape). The strand 12 has at least one continuous support filament 16 coated with a non-detonative, ignitive mixture of powdered fuel, oxidant and a suitable binder. The filament 16 is a material such as glass fiber, metal or a polymeric material. The strand 12 is a fuel preferably having a high heat of combustion greater than 2000 calories per gram. Suitable powdered fuels include aluminum, titanium, magnesium, a 50/50 magnesium/aluminum alloy, amorphous boron, 70/30 zirconium/nickel alloy or calcium silicide as disclosed in the aforementioned U.S. Pat. No. 4,220,087, the contents of which are incorporated herein by reference to the extent necessary to supplement this disclosure. Suitable oxidants include potassium perchlorate, ammonium perchlorate, or nitrates, chromates, polychromates or other perchlorates of alkali or alkaline earth metals, ammonia, or organic bases.

A wide variety of polymeric binders with suitable properties are available, and the binder is chosen to provide compatibility with the fuel and oxidant combination, as well as to provide the desired adhesion, mechanical strength, and storage capability.

The ingredients enumerated here are only typical, and as will be recognized by those skilled in the art, the ultimate choice of materials is based upon the best solution to the particular design criteria to be satisfied.

Sheath 14 is fabricated of a frangible material such as plastic, metal, ceramic, or a composite material such as a synthetic resin containing high strength fibers. The inner surface of the sheath 14 has a substantially triangular shape, such that the outer surface of the strand 12 contacts the inner surface of the sheath 14 at three locations, which support and confine strand 12 within the sheath 14. Gas or air channels 18 are defined by the spaces between the inner surface 22 of sheath 14 and outer surface 24 of strand 12. As used herein in connection with the geometric shapes defined by the cross section of the inner surface 22 of sheath 14, "substantially" triangular encompasses both a true triangular cross section and a triangle where the apexes are rounded. The degree of curvature at the apexes will vary from application to application of the invention.

Sprinkled and free floating within the channels 18 is an ignition material 20 such as Perkal (a mixture of ammonium perchlorate, potassium perchlorate and aluminum) or other ignition materials known in the art. In this and in the other embodiments disclosed, strand 12 is of substantially, (i.e., within manufacturing tolerances), uniform cross-section, and the gas channels 18 extend continuously throughout the length of the fuze. The ends of the sheath 14 can be left open, or they can be sealed or plugged by suitable means, not shown.

In a preferred method of manufacture, the supporting filament 16 is coated with the mixture of powdered fuel, oxidant, modifiers and binder with solvents in an extrusion process, and the mixture is allowed to dry. Sheath 14 is also formed by extrusion and the strand 12 is positioned in the sheath 14 during the extrusion process.

Figure 2:
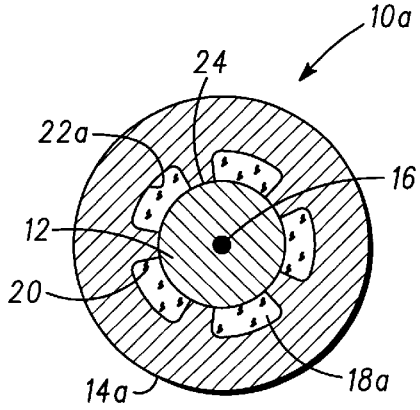
FIG. 2 is an enlarged transverse cross-sectional view of an alternative embodiment of the linear ignition fuze of contemplated by the present invention.

In an alternative embodiment, illustrated in FIG. 2 a fuze 10*a* is identical to fuze 10 except that the fuze 10*a* has a sheath 14*a* with an inner surface 22*a* having splined shape so that the outer surface 24 of strand 12 contacts the inner surface 22*a* of the sheath 14 at three or more locations. The number of splines and hence the number of contact locations may vary from application to application. The gas or air channels 18*a* are defined by the spaces between the sheath 14*a* and strand 12.

Figure 3:
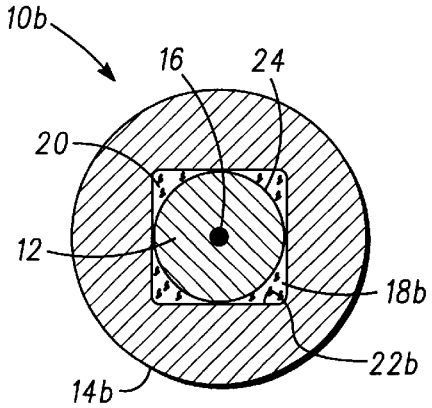
FIG. 3 is an enlarged transverse cross-sectional view of another alternative embodiment of the linear ignition fuze of contemplated by the present invention.

In another alternative embodiment, illustrated in FIG. 3, a fuze 10*b* is identical to fuze 10 except that the fuze 10*b* has a sheath 14*b* with an inner surface 22*b* having a substantially rectangular or square shape, such that the outer surface 24 of strand 12 contacts the inner surface 22*b* of sheath 14 at four locations. The gas or air channels 18*b* are defined by the spaces between sheath 14*b* and strand 12. As with the term "substantially" triangular, the term "substantially" square or rectangular encompasses both a true square or a true rectangle and a square or rectangle in which the points at which the sides meet are rounded or curved. The degree of curvature at the points will vary from application to application of the invention.

Figure 4:
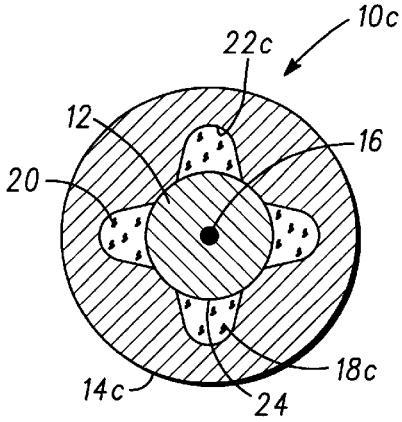
FIG. 4 is an enlarged transverse cross-sectional view of yet another alternative embodiment of the linear ignition fuze of contemplated by the present invention.

In yet another an alternative embodiment, illustrated in FIG. 4 a fuze 10*c* is identical to fuze 10 except that the fuze 10*c* has a sheath 14*c* with an inner surface 22*c* having lobed shape so that the outer surface 24 of strand 12 contacts the inner surface 22*c* of the sheath 14 at three or more locations. The number of lobes and hence the number of contact locations may vary from application to application of the invention. The gas or air channels 18*c* are defined by the spaces between the sheath 14*c* and strand 12.

Figure 5:
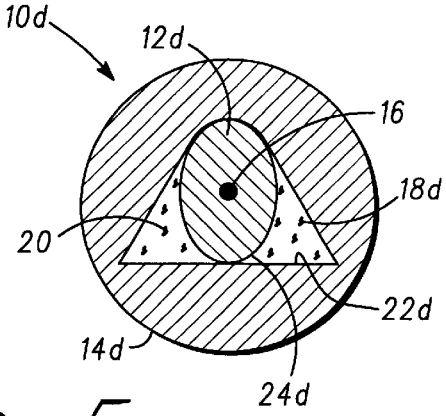
FIG. 5 is an enlarged transverse cross-sectional view of yet another alternative embodiment of the linear ignition fuze of contemplated by the present invention.

In yet another an alternative embodiment, illustrated in FIG. 5 a fuze 10*d* is identical to fuze 10 except that the fuze 10*d* has a core 12*d* with an outer surface 24*d* having an elliptical cross sectional shape so that the outer surface 24*d* of strand 12*d* contacts the inner surface 22*d* of the sheath 14*d* at two locations. The gas or air channels 18*d* are defined by the spaces between the sheath 14*d* and strand 12*d*.

The present invention has a number of important features and advantages. The shape of the inner surface of the sheath (which results in a non-uniform wall thickness when combined with the substantially circular outer surface of the sheath) is inexpensive to form as compared with forming the ignitive core material in shapes other than a substantially cylindrical strand or using a multiple strand core. The shape of the inner surface simultaneously provides confinement of the ignitive material and the gas channels required for reaction propagation. The shape of the inner surface also provides for easy custom tailoring of the ignitive material charge allowing for variable fuze output as well as ease of manufacture inherent with the single solid circular or elliptical core. The present invention provides a non-explosive ignition fuze that is less costly to produce, less hazardous to manufacture, store and use than prior art fuzes and which will propagate an ignitive reaction very rapidly. The fuze of the present invention is relatively lightweight and flexible and produces no toxic gases or obstructive debris when ignited.

It is apparent from the foregoing that a new and improved linear ignition fuze has been provided in which the shape of the inner surface of the sheath is selected to be irregular so as to form gas channels against the outer surface of the substantially cylindrical strand. While only certain presently preferred embodiments have been described, (i.e. triangular, splined, lobed and square), as will be apparent to those familiar with the art, certain changes and modifications can be made without departing from the scope of the invention. In particular, additional shapes for the inner surface of the sheath, such as other polygons, are contemplated by the present invention.

What is claimed is:

1. A linear ignition fuze comprising:

a single elongated core of non-detonating ignitive material; and an imperforate frangible sheath encasing the core, said imperforate frangible sheath comprising a side wall having a non-uniform wall thickness, said side wall comprising an inner surface, the transverse cross section of said inner surface forming a polygon, said side wall and said elongated core contacting each other to form at least one gas channel therebetween for supporting an ignitive reaction that travels along the length of the linear ignition fuze.

2. The linear ignition fuze of claim 1, wherein:

the transverse cross section of said inner surface forms a regular polygon.

3. The linear ignition fuze of claim 2, wherein:

the transverse cross section of said inner surface forms a triangle.

4. The linear ignition fuze of claim 2, wherein:

said side wall comprises an outer surface having a substantially circular cross section.

5. The linear ignition fuze of claim 2, wherein:

the transverse cross section of said inner surface forms a square.

6. A linear ignition fuze comprising:

a single elongated core of non-detonating ignitive material, the transverse cross section of said elongated core defining a solid, unitary body having a closed arcuate outer surface; and an imperforate frangible sheath encasing the core, said imperforate frangible sheath comprising a side wall having an inner surface, the transverse cross section of said inner surface forming a polygon, said inner surface of said side wall contacting said closed arcuate outer surface of said elongated core to form at least one gas channel therebetween for supporting an ignitive reaction that travels along the length of the linear ignition fuze.

7. The linear ignition fuze of claim 6, wherein:

the transverse cross section of said elongated core defines a circle.

8. The linear ignition fuze of claim 6, wherein:

the transverse cross section of said elongated core defines an ellipse.

9. The linear ignition fuze of claim 6, wherein:

the transverse cross section of said inner surface forms a regular polygon.

10. The linear ignition fuze of claim 9, wherein:

the transverse cross section of said liner surface forms a triangle.

11. The linear ignition fuze of claim 9, wherein:

the transverse cross section of said inner surface forms a square.

12. A linear ignition fuze comprising:

a single elongated core of non-detonating ignitive material having an outer surface; and an imperforate frangible sheath encasing said core, said imperforate frangible sheath comprising a side wall having an inner surface and a non-uniform wall thickness, the transverse cross section of said inner surface forming a polygon, said inner surface of said side wall and said outer surface of said elongated core contacting to form at least one gas channel therebetween for supporting an ignitive reaction that travels along the length of the linear ignition fuze.

* * * * *